US009434002B2

(12) United States Patent
Nagata et al.

(10) Patent No.: US 9,434,002 B2
(45) Date of Patent: Sep. 6, 2016

(54) EVAPORATING MATERIAL AND METHOD OF MANUFACTURING THE SAME

(71) Applicant: ULVAC, INC., Kanagawa (JP)

(72) Inventors: Hiroshi Nagata, Tsukuba (JP); Yoshinori Shingaki, Tsukuba (JP); Youichi Hirose, Tsukuba (JP); Kyoutoshi Miyagi, Tsukuba (JP)

(73) Assignee: ULVAC, INC., Kanagawa (JP)

( * ) Notice: Subject to any disclaimer, the term of this patent is extended or adjusted under 35 U.S.C. 154(b) by 498 days.

(21) Appl. No.: 14/042,935

(22) Filed: Oct. 1, 2013

(65) Prior Publication Data

US 2014/0027083 A1 Jan. 30, 2014

Related U.S. Application Data

(62) Division of application No. 13/119,993, filed as application No. PCT/JP2009/005168 on Oct. 6, 2009, now abandoned.

(30) Foreign Application Priority Data

Oct. 8, 2008 (JP) ..... 2008-261772
Oct. 22, 2008 (JP) ..... 2008-271904

(51) Int. Cl.
*B22D 23/04* (2006.01)
*C23C 2/04* (2006.01)
(Continued)

(52) U.S. Cl.
CPC ..... *B22D 23/04* (2013.01); *C21D 1/72* (2013.01); *C21D 6/00* (2013.01); *C23C 2/04* (2013.01); *H01F 41/0293* (2013.01); *Y10T 428/12361* (2015.01)

(58) Field of Classification Search
CPC ..... B22D 23/04; C23C 2/04
USPC ..... 164/47, 131
See application file for complete search history.

(56) References Cited

U.S. PATENT DOCUMENTS 4,777,995 A * 10/1988 Reichelt ..... B22D 23/003 164/131
4,783,245 A * 11/1988 Nakamura ..... C25C 3/34 205/368

(Continued)

FOREIGN PATENT DOCUMENTS

CN 101163814 A 4/2008
JP 61-151975 A 7/1986

(Continued)

OTHER PUBLICATIONS

International Search Report for PCT Patent App. No. PCT/JP2009/005168 (Dec. 8, 2009).

(Continued)

*Primary Examiner* — Kevin P Kerns
(74) *Attorney, Agent, or Firm* — Cermak Nakajima & McGowan LLP; Tomoko Nakajima

(57) ABSTRACT

There is provided an evaporating material of thin plate shape which can be manufactured at a reduced cost and at high productivity, the evaporating material being adapted for use in enhancing the coercive force of neodymium-iron-boron sintered magnet by heat treatment while evaporating Dy in vacuum or in reduced-pressure inert gas atmosphere. The evaporating material of this invention has a core member 1*a* made of a fire-resistant metal having a multiplicity of through holes, and is made by melting a rare-earth metal or an alloy thereof so as to get adhered to, and solidified on, the core member. In this case, the above-mentioned adhesion is performed by dipping the core member into a molten bath of the rare-earth metal or an alloy thereof, and pulling it out of the molten bath.

7 Claims, 9 Drawing Sheets

(51) Int. Cl.

| | |
|---|---|
| ***C21D 1/72*** | (2006.01) |
| ***C21D 6/00*** | (2006.01) |
| *H01F 41/02* | (2006.01) |

(56) References Cited

U.S. PATENT DOCUMENTS

| | | | |
|---|---|---|---|
| 5,104,695 | A | 4/1992 | Greer et al. |
| 8,075,954 | B2 | 12/2011 | Nagata et al. |
| 8,257,511 | B2 | 9/2012 | Nagata et al. |
| 2008/0257716 | A1 | 10/2008 | Nagata et al. |
| 2010/0159129 | A1 | 6/2010 | Nagata et al. |
| 2011/0189498 | A1 | 8/2011 | Nagata et al. |
| 2011/0293829 | A1 | 12/2011 | Nagata et al. |

FOREIGN PATENT DOCUMENTS

| | | | |
|---|---|---|---|
| JP | 2-197564 | A | 8/1990 |
| JP | 2000-345324 | A | 12/2000 |
| JP | 2001-059164 | A | 3/2001 |
| JP | 2006-128490 | A | 5/2006 |
| JP | 2007-099618 | A | 4/2007 |
| JP | 2009-135393 | A | 6/2009 |
| WO | WO2008/023731 | A1 | 2/2008 |

OTHER PUBLICATIONS

Office Action from Chinese Patent App. No. 200980140043.7 (Sep. 13, 2012).

Office Action from Korean Patent App. No. 10-2011-7010244 issued Jun. 3, 2013.

* cited by examiner

FIG.7

| SAMPLE | 1 | 2 | 3 | 4 | 5 | 6 | 7 | 8 | 9 | COMPARATIVE EXAMPLE |
|---|---|---|---|---|---|---|---|---|---|---|
| MESHES (#) | 2 | 5 | 8 | 10 | 20 | 30 | 40 | 50 | 60 | PLATE |
| WIRE DIAMETER (mm) | 2 | 1.9 | 1.2 | 0.5 | 0.4 | 0.35 | 0.22 | 0.12 | 0.1 | — |
| MATERIAL | Mo | Ta | Nb | Nb | Mo | Ta | Nb | Nb | Nb | Mo |
| POROSITY (%) (SPOTS FREE FROM Dy) | 100 | 60 | 0 | 0 | 0 | 0 | 0 | 0 | 0 | 0 |
| Dy WEIGHT (g) PER 10 $CM^3$ | 1 | 20 | 40 | 45 | 55 | 50 | 41 | 32 | 26 | 8 |

FIG.9

| PULL-UP SPEED (m/s) | 0.005 | 0.01 | 0.05 | 0.2 | 0.5 | 1 |
|---|---|---|---|---|---|---|
| RESULT | × | ○ | ○ | ○ | ○ | × |

FIG.10

| | ELEMENT | SPECIFIC HEAT | SPECIFIC WEIGHT | CALORIFIC VALUE PER UNIT VOLUME (SPECIFIC HEAT X SPECIFIC WEIGHT) |
|---|---|---|---|---|
| | UNIT | J/kg·K | g/cm$^3$ | J/K·m$^3$ |
| COMPARATIVE EXAMPLE | C | 710 | 2.3 | 1,604,600 |
| | Si | 700 | 2.3 | 1,610,000 |
| | Mg | 1020 | 1.7 | 1,734,000 |
| EXAMPLE | Nb | 265 | 8.6 | 2,271,050 |
| | Ta | 140 | 16.6 | 2,324,000 |
| | Ti | 520 | 4.5 | 2,340,000 |
| | W | 130 | 19.2 | 2,496,000 |
| | Mo | 250 | 10.2 | 2,550,000 |
| | V | 490 | 6.1 | 2,989,000 |
| COMPARATIVE EXAMPLE | Cu | 379 | 8.9 | 3,373,100 |

EVAPORATING MATERIAL AND METHOD OF MANUFACTURING THE SAME

This application is a Divisional under 35 U.S.C. §120 of U.S. patent application Ser. No. 13/119,993, now abandoned, filed on Jul. 19, 2013, which was a national phase entry under 35 U.S.C. §371 of PCT Patent Application No. PCT/JP2009/005168, filed on Oct. 6, 2009, which claims priority under 35 U.S.C. §119 to Japanese Patent Application No. 2008-261772, filed Oct. 8, 2008, and Japanese Patent Application No. 2008-271904, filed on Oct. 22, 2008, all of which are incorporated by reference.

TECHNICAL FIELD

The present invention relates to an evaporating material and a method of manufacturing the evaporating material. Particularly, it relates to an evaporating material and the method of manufacturing the evaporating material which is adapted for use in manufacturing high-performance magnets to improve the coercive force of neodymium-iron-boron sintered magnet or hot plastic working magnet by carrying out heat treatment while evaporating dysprosium or terbium in vacuum or in a reduced-pressure inert gas atmosphere.

BACKGROUND ART

Conventionally, in order to obtain a high-performance magnet having a dramatically enhanced coercive force, the following art has been proposed (e.g., in Patent Document 1) by the applicant of this patent application. The art in question discloses: to contain in a processing box neodymium-iron-boron sintered magnets and evaporating materials containing at least one of dysprosium (Dy) and terbium (Tb) at a distance from each other; to heat the processing box in a vacuum atmosphere to thereby evaporate the evaporating materials; to adjust the amount of supply of the evaporated metal atoms to the surfaces of the sintered magnets so that the metal atoms get adhered; and to perform the processing treatment to diffuse the adhered metal atoms into the grain boundaries and/or grain boundary phases of the sintered magnets so that a thin film made up of the metal evaporating material is not formed on the respective surfaces of the sintered magnets (vacuum vapor processing).

In the art of the above-mentioned Patent Document 1, as the evaporating materials, small particles, for example, were used so that they can be disposed around the sintered magnets that have been disposed inside the processing box. When the evaporating materials of this kind are used, the volumetric occupancy becomes large and, as a result, the amount of charging of magnets into the processing box cannot be increased. There was therefore a disadvantage in that the cost becomes higher for the above-mentioned processing treatment. In addition, there is another disadvantage in that the work of manually disposing small particles of evaporating materials into the processing box together with the sintered magnets is troublesome.

As a solution, the applicant of the present patent application has proposed to contain, inside the processing box, plate-shaped evaporating materials and sintered magnets by vertically stacking them while interposing spacers thereby preventing them from coming into contact with one another and thereby allowing for the metal atoms to pass therethrough (see Japanese Patent Application No. 2008-41555).

As a method of manufacturing a thin plate of Dy or Tb, it is considered to melt the ingots of Dy or Tb and cast them into slabs, e.g., in an inert gas atmosphere, and then subject them to rolling work. However, since Dy and Tb have high melting points and are extremely active, they react with the furnace materials or casting molds. It is therefore difficult to melt and cast them into slabs without inclusion of impurities therein. Even conceding that the melting and casting into slabs were possible, they have hexagonal lattice structure and thus are poor in workability. In addition, in order to roll them into thin plates, it becomes necessary to subject them to heat treatments in an inert gas for several times for annealing during the processing treatments. There was therefore a problem in that the manufacturing costs of the plate-like evaporating materials rapidly rise.

PRIOR ART DOCUMENT

Patent Document

Patent Document 1: WO 2008/023731

SUMMARY OF THE INVENTION

Problems to be Solved by the Invention

In view of the above points, this invention has a first problem of providing a plate-shaped evaporating material which can be manufactured at low cost. It is a second problem to provide a method of manufacturing an evaporating material which is capable of manufacturing a plate-shaped evaporating material at a high productivity and at a low cost.

Means for Solving the Problems

In order to solve the above-mentioned first problem, the evaporating material according to this invention comprises a core member made of a fire-resistant metal and having a multiplicity of through holes. The core member has a rare-earth metal or an alloy thereof that is melted, adhered to, and solidified on, the core member.

According to this invention, the rare-earth metal or the alloy thereof is melted, and the core member is dipped into the molten bath of the rare-earth metal or of the alloy thereof, and the core member is then pulled up or lifted. Alternatively, the core member is sprayed with the molten rare-earth metal or the molten alloy thereof (thermal spraying). At this time, since the core member has the multiplicity of through holes, the molten rare-earth metal or the molten alloy thereof gets adhered to the surface of the core member through surface tension of the through holes. By cooling the core member in this state down to the temperature below the melting point of the rare-earth metal or the alloy thereof, the molten rare-earth metal or the molten alloy thereof gets solidified. There can thus be obtained an evaporating material of plate shape, cylindrical shape, or the like in which each of the through holes are occupied and also in which the surface of the core member is coated with the rare-earth metal or the alloy of the rare-earth metal.

According to this invention, as described above, it is not necessary to subject the rare-earth metal or the alloy thereof to melting and casting into slabs. In addition, by making the core member itself into the plate shape, there can be easily obtained an evaporating material in a plate shape. In this manner, without requiring particular cutting work, rolling work, or the like, it is possible to eliminate the raw material losses due to the occurrence, as a result of cutting work or the like, of portions that cannot be utilized as the evaporating material. As combined effects of the above, the evaporating material can be manufactured at an extremely low cost.

In this invention, preferably the rare-earth metal or the alloy thereof adhered to the core member is formed by dipping the core member into a molten bath of the rare-earth metal or of the alloy thereof, and by pulling up the core member therefrom. According to this arrangement, as compared with the case in which the rare-earth metal or the alloy thereof is caused to get adhered by thermal spraying, the adhesion of the rare-earth metal or the alloy thereof to the core member can be made easily. In addition, since there will be no waste in the raw material, the productivity can be further enhanced and further reduction in cost can be attained.

In this invention, preferably the rare-earth metal is a member selected from the group consisting of terbium, dysprosium, and holmium.

Preferably, the fire-resistant metal is a member selected from the group consisting of niobium, molybdenum, tantalum, titanium, vanadium, and tungsten.

Further, the core member preferably comprises one of a net member which is made by assembling a plurality of wire materials into lattice shape, an expanded metal, and a perforated metal.

The evaporating material according to the above-mentioned arrangement is heat-treated while evaporating (sublimating) the evaporating material inclusive of dysprosium and terbium in vacuum or in a reduced-pressure inert gas atmosphere, the evaporating material being adapted for use in enhancing a coercive force of neodymium-iron-boron sintered magnet or hot plastic working magnet.

In order to solve the above-mentioned second problem, the method of manufacturing an evaporating material according to this invention comprises the steps of: forming a solidified body of a rare-earth metal or of an alloy thereof by melting the rare-earth metal or the alloy thereof, dipping a base member made of a fire-resistant metal into a molten bath of the rare-earth metal or of the alloy thereof in a state of maintaining the base member at a temperature below the melting temperature of the rare-earth metal or the alloy thereof, and thereafter pulling up the base member to thereby form on a surface of the base member the solidified body; detaching the solidified body off from the base member; and working the solidified body thus detached into a plate shape.

According to this invention, the rare-earth metal or the alloy thereof is melted, and the base member which is below the melting temperature, e.g., at room temperature, and in a predetermined shape is dipped into this molten bath. At this time, if the base member having a large thermal capacity per unit volume is dipped, the molten bath is rapidly cooled by the base member. As a result, there will be formed on the surface of the base member a film made of the rare-earth metal or the alloy thereof. By pulling out the base member out of the molten bath, the film is immediately cooled to a temperature below the melting point and is solidified. There will thus be formed on the surface of the base member a solidified body made of the rare-earth metal or the alloy thereof having a predetermined thickness. Since the molten bath metal does not react with the base member, the solidified body can be easily peeled off from the base member only by adding vibrations or shocks. Finally, the solidified body that has been detached is cut off by cutting work into a plate shape or is formed into a plate shape, after cutting work, by rolling or pressing work, thereby obtaining an evaporating material in plate shape. In this invention, in order to enable to adhere the molten bath to the base member, the thermal capacity of the base member per unit volume is required to be about at least 2 $MJ/km^3$.

As described, according to this invention, it is not necessary to subject the rare-earth metal or the alloy thereof to casting by melting into slab shape. In addition, by performing cutting work, rolling work or the like to the material that has been detached off from the base member, there can be obtained an evaporating material of plate shape with smaller number of steps. Therefore, the evaporating material in plate shape can be manufactured at a lower cost and with good productivity.

When the material that has been detached off from the base member is subjected to cutting work or the like in plate shape, the base member is preferably of columnar shape or of prismatic shape in order to facilitate the working and also in order to eliminate the loss in raw material.

Preferably, the time of dipping the base member into the molten bath is increased or decreased, to thereby control the thickness of the solidified body.

On the other hand, there may be employed an arrangement in which the temperature of the base member is changed at the time of dipping the base member into the molten bath, thereby controlling the thickness of the solidified body.

According to this invention, preferably the rare-earth metal is a member selected from the group consisting of terbium, dysprosium, and holmium.

In addition, preferably the fire-resistant metal is a member selected from the group consisting of niobium, molybdenum, tantalum, titanium, vanadium, and tungsten.

BRIEF DESCRIPTION OF THE DRAWINGS

FIG. 7 is a table showing a volumetric ratio and weight of the evaporating material manufactured according to example 1.

FIG. 9 is a table showing whether the evaporating material manufactured according to Example 2 is acceptable or not.

FIG. 10 is a table showing specific heat, specific weight, and thermal capacity per unit weight of each of the materials of base member used in Example 3.

EMBODIMENTS FOR CARRYING OUT THE INVENTION

A description will now be made of an evaporating material 1, 10 as well as of a method of manufacturing the evaporating material 1, 10 according to an embodiment of this invention, in which the evaporating material is used in the manufacturing of a high-performance magnet which enhances the coercive force of neodymium-iron-boron sintered magnet or hot plastic working magnet by heat-treating the magnet while evaporating Dy in vacuum or in a reduced-pressure inert gas atmosphere.

Figure 1:
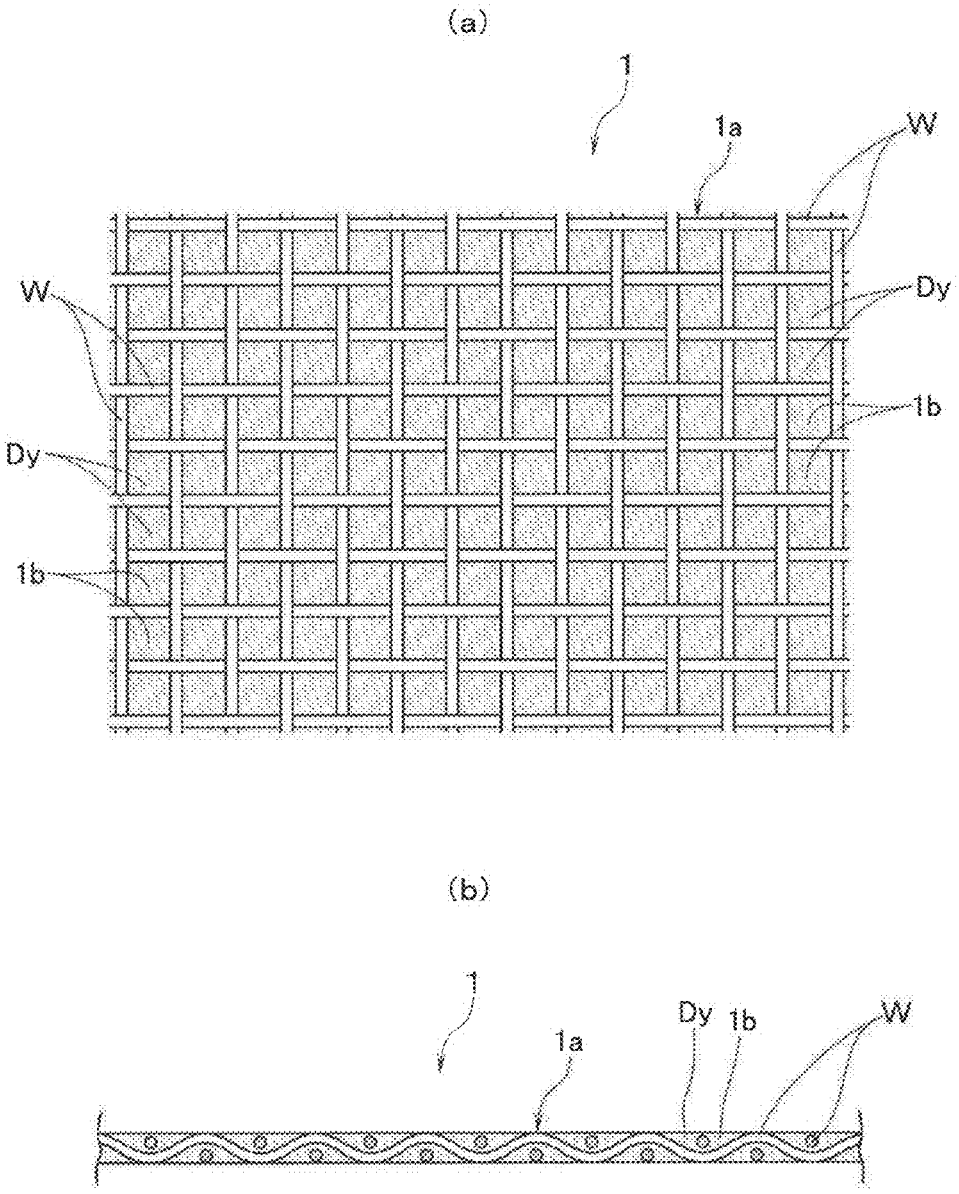
FIGS. 1(*a*) and 1(*b*) are plan view and sectional view, respectively, schematically showing an evaporating material according to a first embodiment of this invention.

With reference to FIG. 1, the evaporating material 1 according to a first embodiment is made: by melting a rare-earth metal or an alloy thereof; by causing the molten metal of the rare-earth metal or the alloy thereof to get adhered to a core member 1*a* made of a fire-resistant material having a multiplicity of through holes; and by solidifying the molten metal. As the core member 1*a*, there is used a net member which is formed by assembling wires W made of fire-resistant metal such as niobium, molybdenum, tantalum, titanium, vanadium, tungsten, or the like into a lattice shape for further forming it into a plate shape. In this case, as the wires W to constitute the net member 1*a*, the diameter shall preferably be 0.1 to 1.2 mm, the apertures of the wire meshes 1*b* as the through holes shall preferably be 8 to 50 meshes, more preferably 10 to 30 meshes. The apertures larger than 50 meshes are not suitable for mass productivity due to lack of strength as the core member 1*a*. On the other hand, the apertures smaller than 8 meshes have a disadvantage in that, even if the core member 1*a* dipped into the molten bath of the rare-earth metal is pulled up out of the molten bath, the rare-earth metal can hardly be adhered to the entire region of the core member 1*a* in a manner to fill the meshes.

On the other hand, as the rare-earth metal or the alloy thereof, aside from Dy, there can be used Tb or an alloy of Dy or Tb with Nd, Pr, Al, Cu, Ga, or the like in order to further enhance the coercive force. In the first embodiment, a description is made of an example in which Dy is exemplified because the rare earth to be used is for the purpose of manufacturing a high-performance magnet. This invention is, however, not to be limited thereto, but may also be applied to a case in manufacturing an evaporating material made of other rare-earth metals such as holmium or the like or the alloy thereof.

Figure 2:
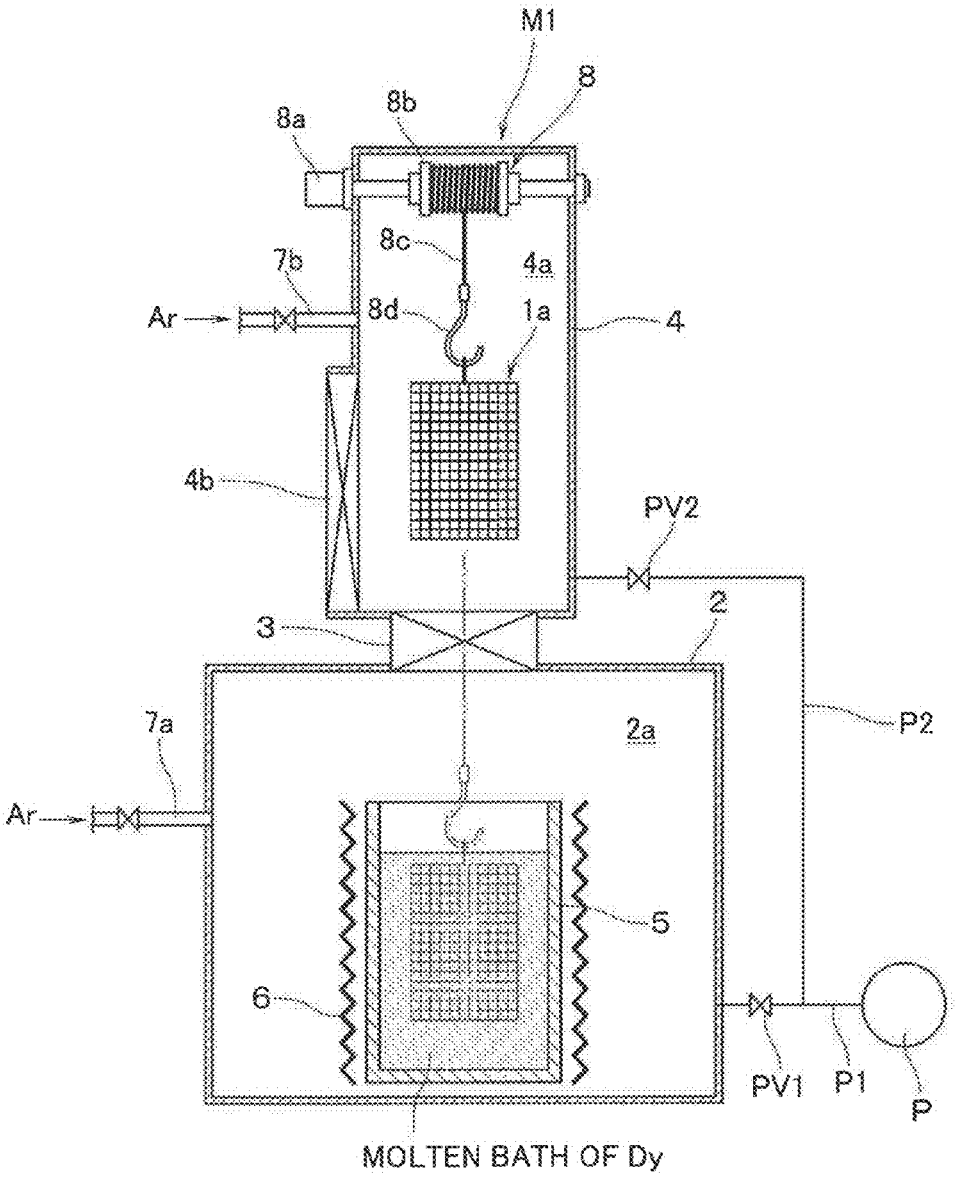
FIG. 2 is a schematic view showing a dipping apparatus used in the manufacturing of the evaporating material according to the above-mentioned first embodiment of this invention.

FIG. 2 shows a dipping apparatus M1 which is used in manufacturing the evaporating material 1 according to the first embodiment. The dipping apparatus M1 has a melting furnace 2 which defines a dipping chamber 2*a*, and a vacuum chamber 4 which defines a preparation chamber 4*a* connected through a gate valve 3 to an upper side of the melting furnace 2.

At the bottom of the melting furnace 2, there is disposed a crucible 5 for containing therein ingots of Dy. The crucible 5 is made up of a fire-resistant metal such as molybdenum, tungsten, vanadium, yttria, tantalum, or the like which does not react with Dy. In addition, inside the melting furnace 2, there is provided a heating means 6 for heating and melting Dy. The heating means 6 has no particular limitation and anything may be used that can heat the Dy inside the crucible 5 above the melting point (1407° C.) so that Dy inside the crucible 5 can be melted and can keep the melted Dy in a state of molten bath. The heating means may thus be of a known tungsten heater or a carbon heater. Otherwise, the heating means may be constituted by a furnace of a high frequency induction type or of an arc melting type. A side wall of the melting furnace 2 has connected thereto a gas introduction pipe 7*a* so that an inert gas such as argon, helium or the like can be introduced into the dipping chamber 2*a* at a predetermined flow amount. In addition, the melting furnace 2 has connected thereto a vacuum pump P for reducing the pressure inside the dipping chamber 2*a*. The connection is made through an exhaust pipe P1 provided with an on-off valve PV1 so that the dipping chamber can be evacuated to a predetermined vacuum pressure and be held at that pressure.

On the other hand, the vacuum chamber 4 is also arranged to be reduced in pressure inside the preparation chamber 4*a*. In this case, the exhaust pipe P2 from the vacuum chamber is connected to the exhaust pipe P1 on the side of the vacuum pump P of the on-off valve PV1. It is thus so arranged that, by controlling the opening and closing of another on-off valve PV2 which is interposed in the exhaust pipe P2, the vacuum chamber can be evacuated by the same vacuum pump P. In addition, the vacuum chamber 4 has connected to the side wall thereof a gas introduction pipe 7*b* so that an inert gas such as argon gas, helium gas or the like can be introduced into the preparation chamber 4*a* at a predetermined flow amount.

One side wall of the vacuum chamber 4 is provided with an open-close door 4*b* for use in bringing in, and taking out, the core member 1*a*. On an inner surface of the upper wall, there is hung an electronic type of hoist 8 so as to be positioned above the crucible 5 in the dipping chamber 2*a*. The hoist 8 is provided with a hoisting mechanism made up of: a drum 8*b* with a motor 8*a* and a wire 8*c* wound around the drum 8*b*; and a hook block 8*d* mounted at the front end of the wire 8*c*. It is so arranged that the core member 1*a* can be moved between a mounting-dismounting position in which the core member 1*a* is mounted on, or dismounted from, the hook block 8*d* by the hoist 8 inside the preparation chamber 4*a*; and a dipping position in which the core member 1*a* mounted on the hook block 8*d* can be dipped in its entirety into the molten bath inside the crucible 5 in the dipping chamber 2*a*.

Here, it is preferable that the hook block 8*d* is made of a fire-resistant material such as molybdenum, tantalum or the like which does not react with the molten Dy. Further, in place of the hook block 8*d*, there may be disposed a holder of fire-resistant make (not illustrated) for holding a plurality of core members 1*a* arranged at a predetermined distance from one another so that a plurality of core members 1*a* may be dipped into the molten bath of Dy at the same time.

Next, a description will be made of the manufacturing of the evaporating material 1 according to the first embodiment by using the dipping apparatus M1 as shown in FIG. 2. First, ingots of Dy are set in position in the crucible 5 in the dipping chamber 2*a*. After having isolated the dipping chamber 2*a* by closing the gate valve 3, the vacuum pump P is operated and also the on-off valve PV1 is opened so as to start the evacuation of the dipping chamber 2*a*. Then, while maintaining the dipping chamber 2*a* at a predetermined pressure (e.g., 1 Pa), Dy is heated. When the temperature of Dy has reached a temperature at which Dy starts sublimation (about 800° C.), Ar gas is introduced through the gas introduction pipe 7*a* into the dipping chamber 2*a*.

The reason why Ar gas is introduced is to prevent the Dy from getting splashed as a result of sublimation. A loss of Dy is thus prevented. Ar gas is introduced in such a manner that the pressure inside the dipping chamber 2*a* becomes 15 to 200 kPa, preferably 50 to 100 kPa. In this state the heating is continued. Once the melting point has reached, Dy gets melted, and the operation of the heating means 6 is controlled to maintain the molten bath temperature (e.g., 1440° C.) at a constant temperature above the melting point.

In the preparation chamber 4*a*, on the other hand, the on-off valve PV2 is opened in a state in which the open-close door 4*b* is kept closed. The preparation chamber is thus once lowered by the vacuum pump P down to a predetermined vacuum pressure (e.g., 1 Pa) to thereby degas the preparation chamber 4*a*. At this time, the hook block 8*d* is in the mounting-dismounting position. Once a predetermined period of time has lapsed after the starting of the evacuation, the on-off valve PV2 is closed and also Ar gas is introduced until the preparation chamber 4*a* becomes an atmospheric pressure so as to return the preparation chamber 4*a* back to the atmospheric pressure. In this state, the open-close door 4*b* is opened to bring in the core member 1*a* and set the core member to be suspended by the hook block 8*d*. After closing the open-close door 4*b*, the on-off valve PV2 is opened once again to thereby evacuate the preparation chamber 4*a* by the vacuum pump P. According to this arrangement, the preparation for dipping the core member 1*a* is finished.

Then, in a state in which the molten bath temperature is maintained at the predetermined temperature, Ar gas is kept introduced through the gas introduction pipe 7*b* into the preparation chamber 4*a* until the preparation chamber reaches the same pressure as that in the dipping chamber 2*a*. Once the dipping chamber 2*a* and the preparation chamber 4*a* have attained the same pressure, the gate valve 3 is opened. In this state, the motor 8*a* of the hoisting means is rotated in the normal direction of rotation so that the core member 1*a* is lowered from the preparation chamber 4*a* toward the dipping chamber 2*a* through the hook block 8*d*. When the core member 1*a* is lowered, the core member is sequentially dipped into the molten bath of Dy and reaches the dipping position.

When the core member has reached the dipping position, the motor 8*a* of the hoisting means is rotated in the opposite direction of rotation so as to sequentially pull the core member 1*a* out of the molten bath through the hook block 8*d*. Here, since the core member 1*a* is made up of wires W, when the core member 1*a* gets dipped into the molten bath, the molten bath of Dy gets penetrated into the wire meshes 1*b* of the core member 1*a* since the core member 1*a* has good wettability with the molten bath of Dy. Since the thermal capacity per unit area of the core member 1*a* is small in this state, the molten bath around the core member 1*a* is in a liquid state. When the core member 1*a* is sequentially pulled up out of the molten bath, the portion pulled up out of the molten bath becomes a state in which the Dy gets adhered so as to fill each of the meshes 1*b* due to its surface tension and so as to cover the surface of the core member 1*a*. Immediately after being pulled up out of the molten bath, the Dy is cooled to a temperature below the melting point and gets solidified. When the core member 1*a* has been completely pulled up out of the molten bath, there can be obtained an evaporating material 1 of plate shape. The speed of pulling up the core member out of the molten bath may appropriately be determined considering the point: that Dy can be solidified in each of the wire meshes 1*b*; and that the amount of adhesion of Dy becomes as uniform and as large as possible; or the like.

Then, when the hook block 8*d* reaches the mounting position, the gate valve 3 is closed. In this state, Ar gas (e.g., of 100 kPa) is further introduced into the preparation chamber 4*a* and the evaporating material is cooled for a predetermined period of time. After having cooled, Ar gas is further introduced into the preparation chamber 4*a* to bring it back to atmospheric pressure. The open-close door 4*b* is opened to thereby bring out the evaporating material 1.

In this manner, in the first embodiment, it is not necessary to subject Dy to melting and casting into slabs. Further, a plate-shaped evaporating material made of Dy can be manufactured only by making the core member 1*a* itself into plate shape. Therefore, since no particular cutting work or rolling work is required, it is possible to avoid the loss in raw material that may happen as wastes by cutting work or the like. As a combined effect thereof, it is possible to obtain the evaporating material 1 at an extremely low cost.

Here, as described hereinafter, in case the evaporating material 1 of the first embodiment is used in manufacturing a high-performance magnet, with the progress of consumption of the Dy adhered to the core member 1*a*, holes come to be formed in the meshes 1*b* of the core member 1*a*. As a result, the conditions of consumption of the evaporating material 1 can be visually recognized, which is advantageous in judging when the evaporating material 1 shall be replaced, or the like.

Further, when the evaporating material 1 has been consumed as described above, this consumed evaporating material 1 can be used again without any preliminary treatment. In other words, by dipping the consumed evaporating material 1 into the molten bath of Dy, and by pulling it up, the evaporating material 1 can be regenerated. As a result, the Dy that remains adhered to the used evaporating material 1 can be reused as it is without throwing it away as a scrap. Expensive rare-earth atoms which are scarce as raw materials such as Dy, Tb or the like can be effectively utilized in an extremely effective manner.

In the above-mentioned first embodiment, a description has been made of an example in which a core member 1*a* was formed into a plate shape. However, without being limited to this example, a cylindrical evaporating material may be manufactured by using a wire net material formed into a cylindrical shape so as to be used as an evaporating material for use in manufacturing a ring-shaped sintered magnet or a hot plastic working magnet. In addition, the core member 1*a* having formed a multiplicity of through holes of a predetermined diameter may serve the purpose. In place of the wire net material, an expanded metal or a perforated metal may be used as well.

In the above-mentioned first embodiment, a description has been made of an example in which the adhesion of Dy was performed by dipping the core member 1*a* into a molten bath of ingots of Dy, and by pulling the core member out of the molten bath. Instead, Dy may get adhered to the core member 1*a* by spraying. Further, in the above-mentioned first embodiment, a description has been made of an example in which the core member 1*a* was manufactured by one time of dipping operation. Instead, it may be so arranged that the dipping is performed in plural times of operations by changing the direction of dipping.

A description will now be made of a second embodiment of the evaporating material 10 with reference to FIG. 3. The evaporating material 10 is manufactured by the following steps, i.e.: a step in which Dy is melted, and a base member 10*a* is dipped into the molten bath of Dy in a state in which the base member 10*a* is maintained at a temperature below the melting temperature of Dy, and the base member is then pulled up or lifted out of the molten bath to thereby form a solidified body 10*b* made of Dy on the surface of the base member 10*a* (solidified body forming step); a step in which the solidified body 10*b* is released or detached off from the base member 10*a* (detaching step); and a step in which the detached solidified body 10*b* is worked into a plate shape (working step).

As the base member 10*a*, out of consideration that the solidified body 10*b* is worked into a plate shape after having formed the solidified body 10*b*, there is used a solid prismatic shape or columnar shape, each being made of a fire-resistant metal such as niobium, molybdenum, tantalum, titanium, vanadium, tungsten or the like. As the base member 10*a*, there is used one having a thermal capacity of about 2.5 MJ/km$^3$. If the thermal capacity is below 2 MJ/km$^3$, as described hereinafter, when the base member is dipped into the molten bath of Dy, the base member 10*a* itself will rapidly rise in temperature so that the Dy film formed on the surface thereof will be melted once again and, as a result, the solidified body 10*b* cannot be formed efficiently.

On the other hand, as the rare-earth metal or the alloy thereof, aside from Dy, there may be used Tb or an alloy made by compounding into Dy or Tb a metal which further enhances the coercive force, such as Nd, Pr, Al, Cu, Ga or the like. Since this second embodiment is also described with reference to the evaporating material adapted for use in manufacturing a high-performance magnet, Dy is used as an example. However, without being limited thereto, this invention can be applied to the manufacturing of other evaporating materials made of other rare-earth metals such as holmium or the like, or of an alloy thereof.

Figure 4:
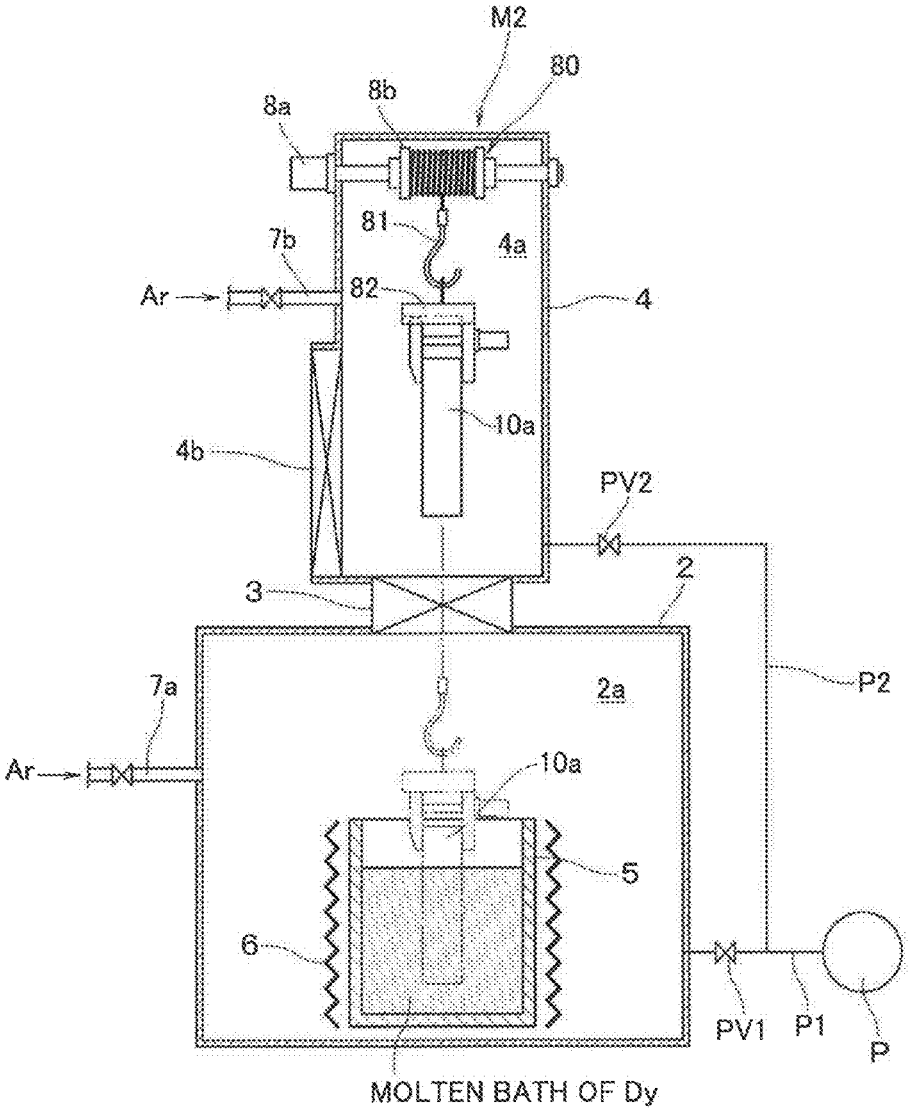
FIG. 4 is a schematic view showing a dipping apparatus used in the manufacturing of the evaporating material according to a modified example of the above-mentioned second embodiment.

In the step of forming the solidified body, a dipping apparatus M2 as shown in FIG. 4 may be used. The dipping apparatus M2 has substantially the same construction as the one employed for the dipping apparatus M1 (see FIG. 2) used in the above-mentioned first embodiment. However, at the front end of a wire 81 of a hoist 80, there is provided, in place of the hook block 8*d*, a clamp 82 for holding one longitudinal end portion of the base member 10*a*. It is thus so arranged that, by means of the hoist 80, the base member 10*a* can be moved between: a mounting-dismounting position in which the mounting or dismounting of the base member 10*a* to and from the clamp 82 is performed inside the preparation chamber 4*a*; and a dipping position in which the base member 10*a* held by the clamp 82 is dipped into the molten bath in the crucible 5 inside the dipping chamber 2*a* except for the portion that is being held by the clamp 82. In FIG. 4, the same reference numerals are assigned to the same parts as in the dipping apparatus M1.

Preferably, the clamp 82 is formed, in a similar manner as in the above-mentioned embodiment 1, of a fire-resistant metal such as molybdenum, tantalum or the like which does not react with the melted Dy. It may also be so arranged that a plurality of clamps 82 are disposed in line at a front end of the wire 81 through a jig (not illustrated) so as to be able to dip a plurality of base members 10*a* into the molten bath of Dy at the same time.

A description will now be made of a case in which, by using the dipping apparatus M2 as shown in FIG. 4, a solidified body 10*b* is formed on the surface of the base member 10*a* of prismatic shape, and then the solidified body 10*b* is worked to thereby obtain a plate-shaped evaporating material 10.

First, ingots of Dy are set in position in the crucible 5 inside the dipping chamber 2*a*. After having isolated the dipping chamber 2*a* by closing the gate valve 3, the vacuum pump P is operated and also the on-off valve PV1 is opened to start evacuation. At the same time, the heating means 6 is operated to start the heating. Then, heating is performed while maintaining the dipping chamber 2*a* to a predetermined pressure (e.g., 1 Pa). When the temperature of Dy has reached a temperature at which Dy starts sublimation (about 800° C.), Ar gas is introduced into the dipping chamber 2*a* through the gas introduction pipe 7*a*.

Here, the purpose of introducing Ar gas is to keep the evaporation of Dy under control. Ar gas is introduced so that the pressure in the dipping chamber 2*a* becomes 15 to 105 kPa, preferably 80 kPa. Heating is continued in this state and, when the melting point has reached, Dy gets melted. The operation of the heating means 6 is then controlled to maintain the molten bath temperature (e.g., 1440° C.) at a constant temperature which is higher than the melting point.

On the other hand, in the preparation chamber 4*a*, the on-off valve PV2 is opened in a closed state of the open-close door 4*b* to thereby once reduce the pressure by the vacuum pump P to a predetermined vacuum pressure (e.g., 1 Pa) to thereby degas the preparation chamber 4*a*. At this time, the preparation chamber 4*a* is at room temperature, and the clamp 82 of the hoist 80 is in the mounting-dismounting position. When a predetermined period of time has lapsed after starting the evacuation, the on-off valve PV2 is closed and Ar gas is introduced until the preparation chamber 4*a* becomes atmospheric pressure so as to return the preparation chamber 4*a* back to the atmospheric pressure. In this state, the open-close door 4*b* is opened to bring the base member 10*a* of room temperature into the preparation chamber (see FIG. 3(*a*)). One longitudinal end portion of the base member 10*a* is caused to be held by the clamp 82 to thereby set the base member in position. Then, after having closed the open-close door 4*b*, the on-off valve PV2 is opened once again to thereby evacuate the preparation chamber 4*a* by the vacuum pump P. According to this arrangement, the preparation for dipping of the base member 10*a* is finished.

Then, in a state in which the molten bath temperature is maintained at a predetermined temperature, Ar gas is introduced into the preparation chamber 4*a* through the gas pipe 7*b* until the preparation chamber 4*a* attains a pressure that is the same as the dipping chamber 2*a*. Then, when the dipping chamber 2*a* and the preparation chamber 4*a* have reached the same pressure, the gate valve 3 is opened and, in this state, the motor 8*a* of the hoisting means is rotated in the normal direction of rotation. The base member 10*a* is thus lowered through the clamp 82 from the preparation chamber 4*a* to the dipping chamber 2*a*. With the lowering of the base member 10*a*, it sequentially gets dipped into the molten bath of Dy, finally reaching the dipping position. The base member is then held at the dipping position for a predetermined period of time. In this case, the holding time is appropriately set depending on the thermal capacity of the base member 10*a* and the thickness to be obtained of the solidified body 10*b*. It is to be noted, however, that dipping beyond the predetermined period of time will result in melting again of the film once formed on the surface of the base member 10*a*. The holding time shall therefore be set taking the above circumstances into consideration.

When a predetermined period of time has lapsed in the above-mentioned state, the motor 8*a* of the hoisting means is rotated in the opposite direction of rotation to thereby sequentially pull the base member 10*a* upward out of the molten bath. Here, by dipping the base member 10*a* of about 2.5 MJ/km$^3$ in thermal capacity per unit volume into the molten bath, the molten bath will be rapidly cooled by the base member 10*a* when the base member 10*a* is dipped into the molten bath, and gets adhered to the surface of the base member 10*a*. As a result, a film made of Dy is formed in a predetermined film thickness. By pulling up the base member 10*a* out of the molten bath in this state, the film will immediately be cooled down to a temperature below the melting point and gets solidified. As a result, a solidified body 10*b* will be formed on the surface of the base member 10*a* (see FIG. 3(*b*)). The speed of pulling up the base member 10*a* is appropriately set considering the time of dipping the jig into the molten bath.

When the clamp 82 has reached the mounting position, the gate valve 3 is closed. In this state, Ar gas is introduced into the preparation chamber 4*a* (e.g., 100 Pa), and the solidified body is cooled for a predetermined period of time. After cooling, Ar gas is further introduced into the preparation chamber 4*a* to bring the preparation chamber 4*a* back to atmospheric pressure. The open-close valve 4*b* is opened, and the base member 10*a* having formed the solidified body 10*b* on the surface is taken out of the preparation chamber.

Then, the solidified body 10*b* is released off from the base member 10*a*. In this case, out of the base member 10*a*, that portion which was held by the clamp 82 is kept free from formation of the solidified body 10*b*. Therefore, in a state in which the solidified body 10*b* is fixed in position, the above-mentioned portion of the base member 10*a* is given a pulling force while subjecting it to appropriate vibrations. The base member 10*a* can thus be pulled out. On the other hand, as shown in FIG. 3(*c*), by cutting the solidified body 10*b* on the longitudinally opposite side of the base member 10*a* along a break line shown in chain line in the figure, by means of cutting work or the like, the longitudinal side surface of the base member 10*a* is exposed. Then as shown in FIG. 3(*d*), the base member 10*a* may be subjected to shocks, pushing forces or the like so that the solidified body 10*b* pushes out the base member 10*a*. In this manner, since the base member 10*a* and the metal of the molten bath do not react with each other, the solidified body 10*b* can be easily released off from the base member 10*a* only by giving vibrations, shocks, or the like.

Figure 3:
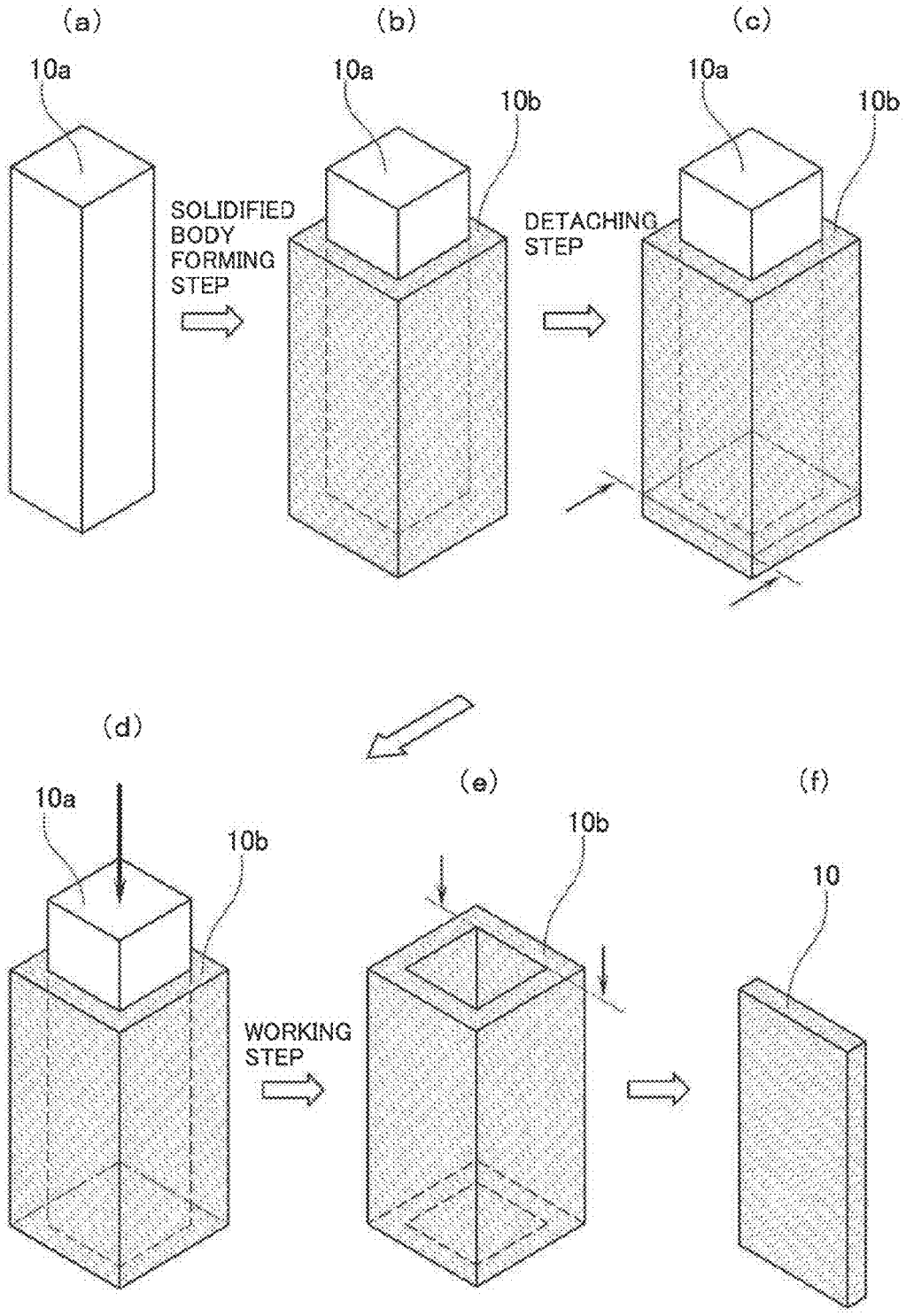
FIGS. 3(*a*) to 3(*f*) are views showing the manufacturing steps of the evaporating material according to a second embodiment of this invention.

Finally, as shown, e.g., in FIG. 3(*e*), if the solidified body 10*b* is cut along a break line shown in chain line in the figure by means of cutting work or the like, there can be obtained a plate-shaped evaporating material (see FIG. 3(*f*)). In this manner, in the second embodiment, it is not necessary to melt and cast Dy into slabs. In addition, since what has been released off from the base member 10*a* is subjected only to cutting work, the plate-shaped evaporating material 10 can be obtained at a low cost and with good productivity.

Further, the evaporating material 10 manufactured as mentioned above may be put to use by further subjecting it to rolling work. It is to be noted here that, if the slabs are manufactured and rolled into thin plates as in the conventional art, the workability is poor due to the crystal structure of hexagonal lattice that is present therein. In order to roll the slabs into thin plates, it is necessary to subject them, in the course of the processing treatments, to heat treatment for annealing, thereby giving rise to the problem of jumping in manufacturing cost. The product manufactured according to this invention, on the other hand, is a thin plate of several mm in thickness and has fine structure due to rapid cooling. Therefore, it is rich in rolling characteristics so as to be capable of rolling down to below 1 mm without the need for annealing.

In the above-mentioned second embodiment, a description has been made of an example of prismatic shape as the base member 10*a*. However, without being limited thereto, a columnar shape may also be employed. In this case, a ring-shaped solidified body in cross section which is detached from the base member 10*a* is cut along the longitudinal direction so as to become semicircular in cross section. What is thus obtained may then be subjected to rolling or press working, thereby obtaining a plate-shaped evaporating material.

Further, in the above-mentioned second embodiment, a description has been made of an example in which the thickness of the solidified body 10*b* is varied by changing the time of dipping in the dipping position. Without being limited thereto, the temperature of the base member 10*a* at the time of dipping into the molten bath may be changed to thereby control the thickness of the solidified body 10*b*. In this case, a known cooling means may be disposed inside the vacuum chamber 4 to thereby control the temperature of the base member 10*a*.

Still furthermore, in the above-mentioned second embodiment, a description has been made of an example in which the base member 10*a* was dipped into the molten bath of melted ingots of Dy. Without being limited thereto, e.g., Dy is evaporated inside the processing chamber to thereby form a vapor atmosphere of Dy, and the base member 10*a* of, e.g., normal temperature is brought into the vapor atmosphere of Dy. Due to the difference in temperature between the two, Dy may be caused to be adhered and deposited on the base member. In this manner, the solidified body according to a modified example can be formed by cooling. This kind of processing apparatus was made the subject of an International Patent Application by the applicant of this patent application and is described in internationally laid-open No. WO2006/100968. Therefore, the details thereof are omitted here.

Now, a description will be made of the manufacturing of high-performance magnet in which was used the plate-shaped evaporating material 1 or 10 manufactured according to the above-mentioned first and the second embodiments. The high-performance magnet was manufactured by performing a series of processing treatments (vacuum vapor processing) at the same time, i.e., the evaporating material 1 (10): was caused to be evaporated and the evaporated Dy atoms were caused to get adhered to the surface of known neodymium-iron-boron sintered magnet S that was formed into a predetermined shape; and was diffused into the grain boundaries and/or grain boundary phases of the sintered magnet S so as to be spread uniformly. A description will hereinafter be made, with reference to FIG. 5, of a vacuum vapor processing apparatus to perform this kind of vacuum vapor processing.

Figure 5:
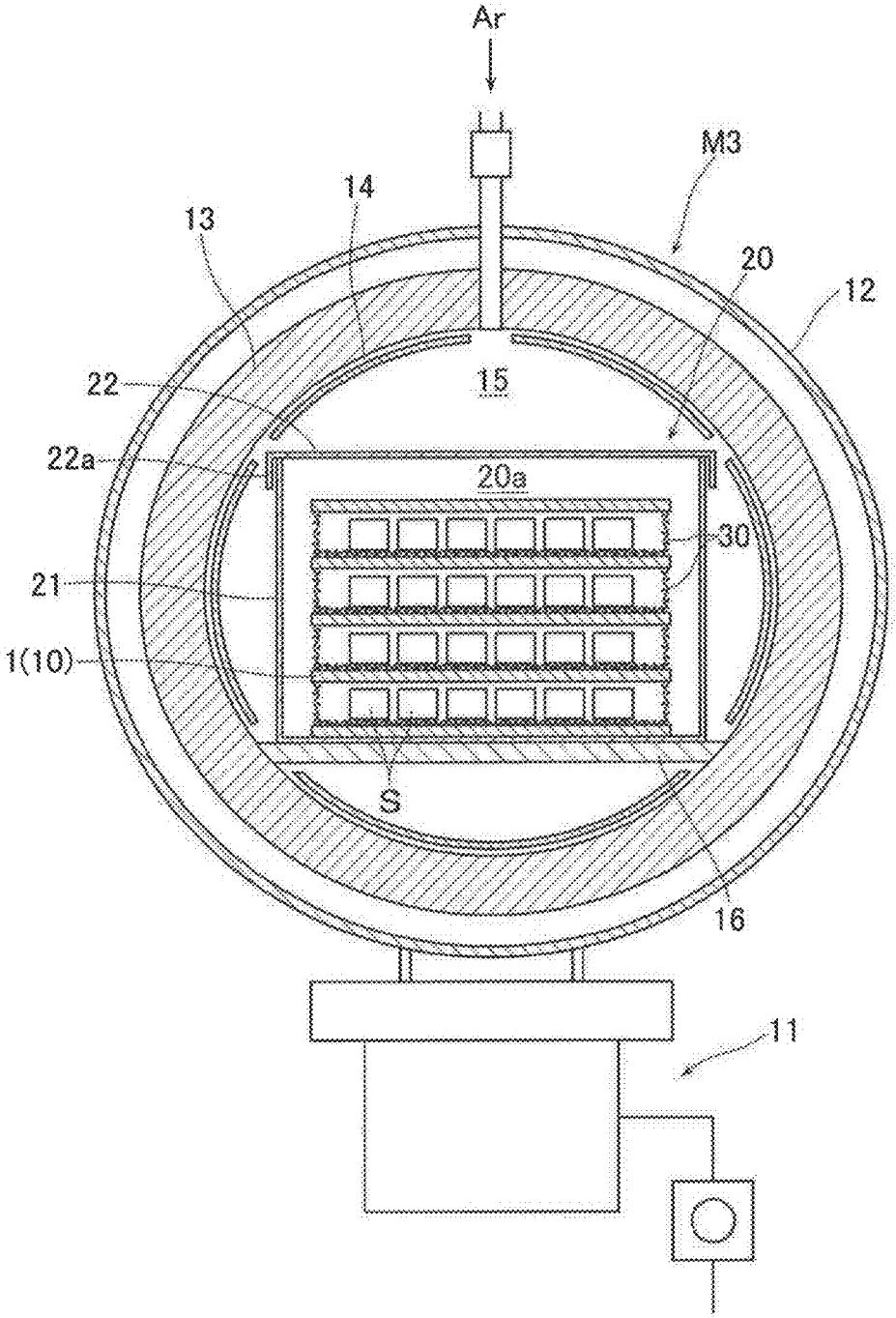
FIG. 5 is a view schematically showing a vacuum evaporating processing apparatus in which the evaporating material of this invention is used.

As shown in FIG. 5, the vacuum vapor processing apparatus M3 has a vacuum chamber 12 which can be reduced in pressure down to a predetermined pressure (e.g., $1\times10^{-5}$ Pa) and can be maintained thereat through an evacuating means 11 such as a turbo molecular pump, a cryo-pump, a diffusion pump or the like. Inside the vacuum chamber 12 there are provided an insulating material 13 which encloses the circumference of a processing box 20 (to be described hereinafter), and a heat generating body 14 which is disposed on the inside thereof. The insulating material 13 is made, e.g., of Mo, and the heat generating body 14 is an electric heater having a filament of Mo make (not illustrated). The filament is energized by a power source (not illustrated) of an electrical resistance heating system, and is enclosed by the insulating material 13 and can heat the space 15 in which the processing box 20 is disposed. In this space 15 there is disposed a mounting table 16, e.g., of Mo make so that at least one processing box 20 can be mounted thereon.

The processing box 20 is made up of a box portion 21 of rectangular parallelepiped with an upper surface left open, and a lid portion 22 which is detachably mounted on an upper surface of the open box portion 21. The outer peripheral portion of the lid portion 22 has formed a flange 22*a* around the entire circumference thereof in a manner to be bent downward. When the lid portion 22 is mounted on the upper surface of the box portion 21, the flange 22*a* gets fit into the outer wall of the box portion 21 (in this case no vacuum sealing such as metal seal is provided), whereby a processing chamber 20*a* isolated from the vacuum chamber 12 is defined. Then, when the vacuum chamber 12 is reduced in pressure down to a predetermined pressure (e.g., $1\times10^{-5}$ Pa) by operating the evacuating means 11, the processing chamber 20*a* will be reduced to a pressure which is higher (e.g., $1\times10^{-4}$ Pa) than that in the vacuum chamber 12.

Figure 6:
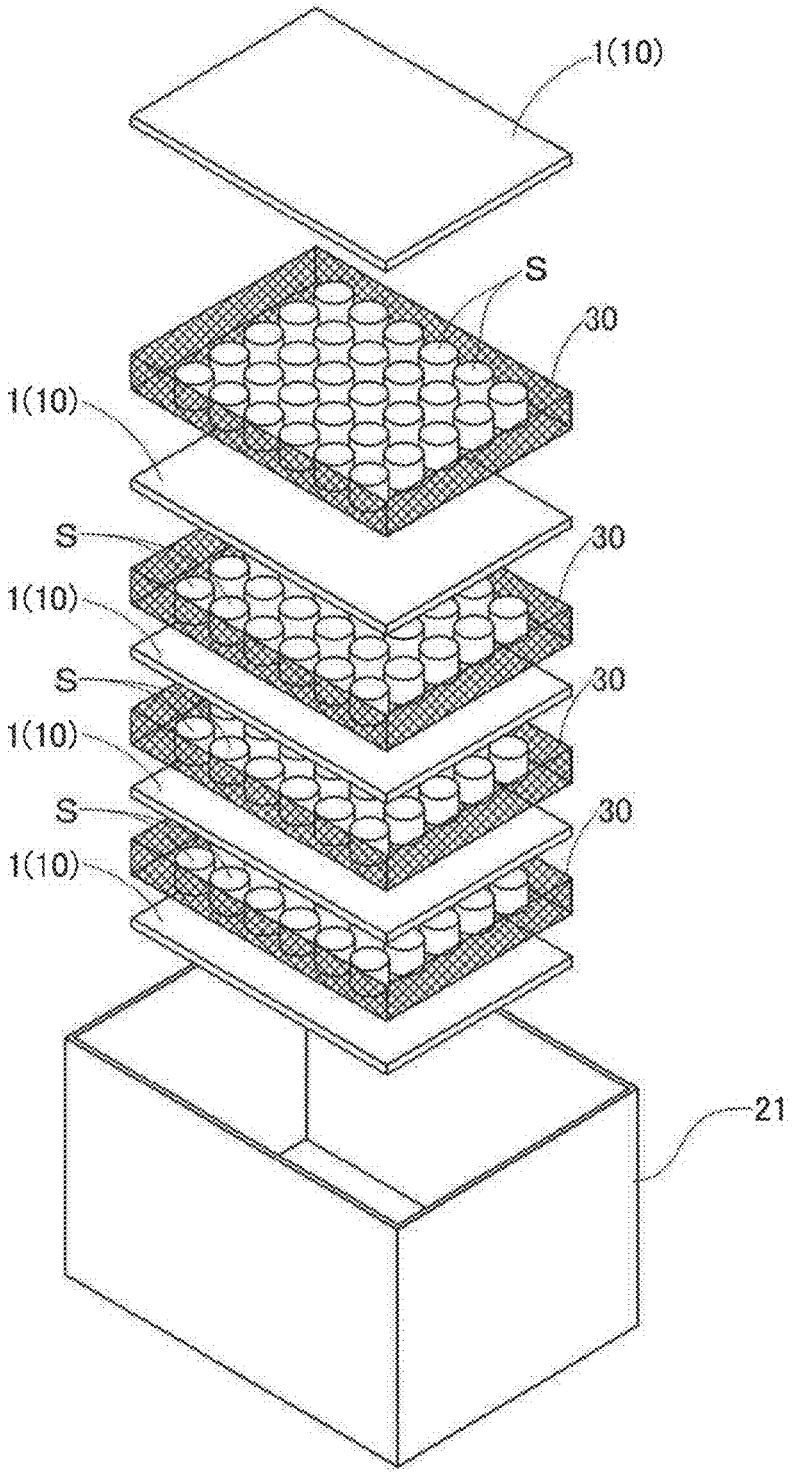
FIG. 6 is a view showing how the evaporating materials and sintered magnets are housed into a processing box.

As shown in FIG. 6, the box portion 21 of the processing box 20 contains therein the sintered magnets S and the evaporating materials 1 according to the above-mentioned embodiment. The sintered magnets S and the evaporating materials 1 are vertically stacked with spacers 30 interposed among them so as to prevent them from coming into contact with one another. Each of the spacers 30 is constituted by arranging a plurality of wire materials (e.g., 0.1 to 10 mm in diameter) into a lattice shape so as to become smaller area in cross section than the lateral cross section of the box portion 21. The outer peripheral portion of the spacer 30 is bent upward substantially at right angles. The height of this bent portion is set depending on the height of the sintered magnets S to be subjected to vacuum vapor processing. On the horizontal portion of this spacer 30, a plurality of sintered magnets S are mounted by disposing at a uniform distance from one another. It is preferable to dispose, among the sintered magnets, those portions having larger surface areas to lie opposite to the evaporating materials 1 (10). In addition, the spacers 30 may be constituted by plate members or bar members. By appropriately disposing the spacers among the sintered magnets S, the sintered magnets S on the lower stage can advantageously be prevented from being deformed under the load of the sintered magnets S on the upper stage.

After having disposed an evaporating material 1 (10) on the bottom surface of the box portion 21, the spacer 30 on which the sintered magnets S are disposed in lines is mounted on top thereof, and another evaporating material 1 (10) is disposed thereon. In this manner, the evaporating materials 1 (10) and the spacers 30 having disposed thereon in lines a plurality of sintered magnets S are alternately stacked with each other in layers to the upper end of the processing box 20. Since the lid portion 22 is positioned close to the spacer 30 on the uppermost stage, the evaporating material 1 may be omitted.

In this manner, the sintered magnets S and the evaporating materials 1 (10) are first disposed in the box portion 21. After having mounted the lid portion 22 on the opened upper surface of the box portion 21, the processing box 20 is disposed on the mounting table 16. Then, the vacuum chamber 12 is reduced in pressure by evacuating through the evacuating means 11 until it reaches a predetermined pressure (e.g., $1\times10^{-4}$ Pa). When the vacuum chamber 12 has reached the predetermined pressure, the heating means 14 is operated to heat the processing chamber 20*a*.

When the temperature in the processing chamber 20*a* under reduced pressure has reached a predetermined temperature, the Dy in the processing chamber 20*a* is heated to substantially the same temperature as that of the processing chamber 20*a*. As a result, Dy starts evaporating and Dy vapor atmosphere is formed in the processing chamber 20*a*. At this time, an inert gas such as Ar or the like is introduced into the vacuum chamber 12 at a constant amount of introduction from a gas introduction means (not illustrated). According to this arrangement, the inert gas is also introduced into the processing box 20 and, by means of the inert gas, the metal atoms that have been evaporated in the processing chamber 20*a* get diffused. The introduction pressure of the inert gas such as Ar or the like shall preferably be 1 kPa to 30 kPa, more preferably 2 kPa to 20 kPa.

In order to control the evaporating amount of Dy, the heating means 14 is controlled to set the temperature in the processing chamber to a range of 800 to 1050° C., preferably of 850 to 950° C. (for example, when the temperature in the processing chamber is 900° C. to 1000° C., the saturated vapor pressure of Dy will be about $1\times10^{-2}$ to $10^{-1}$ Pa).

According to the above arrangement, the amount of evaporation of Dy can be controlled by adjusting the partial pressure of the inert gas such as Ar or the like, and the Dy atoms that have been evaporated by the introduction of the inert gas are diffused inside the processing chamber 20*a*. As a result of combined effects in that the Dy atoms are caused to get adhered to the entire surfaces of the sintered magnets S while controlling the amount of supply of Dy atoms to the sintered magnets S, and that the diffusion speed becomes faster by heating the sintered magnets S in a predetermined temperature range, the Dy atoms that have been adhered to the surfaces of the sintered magnets S can be efficiently diffused and uniformly spread into the grain boundaries and/or grain boundary phases before being deposited on the surfaces of the sintered magnets S, thereby forming a Dy layer (thin film).

As a result, the magnet surfaces can be prevented from getting deteriorated. In addition, it is restrained for the Dy to be excessively diffused into the grain boundaries in the regions closer to the surfaces of the sintered magnets. Since the grain boundary phases have Dy-rich phases (phases having Dy in the range of 5 to 80%) and, furthermore, Dy is diffused only near the surfaces of the grain boundaries. Consequently, the magnetizing force and the coercive force can effectively be enhanced or recovered. In addition, there can be obtained high-performance magnets which do not require finish working and which are superior in productivity.

Finally, after having carried out the above-mentioned processing treatments for a predetermined period of time (e.g., 4 to 48 hours), the operation of the heating means 14 is stopped and also the introduction of the inert gas by the gas introduction means is stopped once. Successively, the inert gas is introduced once again (100 kPa) to stop the evaporation of the evaporating materials 1, 10. Then, the temperature in the processing chamber 20*a* is once lowered to, e.g., 500° C. Thereafter, the heating means 14 is operated once again. By setting the temperature in the processing chamber 20*a* to a range of 450° C. to 650° C., heat treatment is performed to further enhance or recover the coercive force. Then, the processing chamber is rapidly cooled down to about room temperature to thereby take out the processing box 20 out of the vacuum chamber 12.

Example 1

In Example 1, the evaporating materials 1 were manufactured by using the dipping apparatus M1 as shown in FIG. 2. As the core members 1*a* there were prepared ones that were formed into a plate shape of 100 mm×100 mm in size, each by varying the quality of material of the wire and the diameter and meshes of the wire (samples 1 to 9 in FIG. 7). As a comparative example, there was prepared a plate member (sample 10) of Mo make which is 100 mm×100 mm in size and 0.5 mm in thickness. As the rare-earth metal for deposition, Dy (composition ratio 99%) was used. The same processing treatments were performed on samples 1 to 10 under the same conditions.

First, 160 kilograms of ingots were set in position inside the crucible (300 mm in diameter×300 mm). After having isolated the dipping chamber 2*a* by closing the gate valve 3, the vacuum pump P was operated to start evacuation. At the same time, the heating means 6 was operated to start heating. Then, heating was performed while maintaining the pressure inside the dipping chamber 2*a* to 1 Pa. When the temperature of Dy has reached 800° C., Ar was introduced into the dipping chamber 2*a* through the gas introduction pipe 7*a*.

On the other hand, in the preparation chamber 4*a*, the pressure therein was once reduced to 1 Pa by the vacuum pump P in a state of closing the open-close door 4*b*, and maintained the pressure for one minute to thereby degas the preparation chamber 4*a*. Thereafter, Ar gas was introduced until the preparation chamber 4*a* attained the atmospheric pressure. Then, the open-close door 4*b* was opened and the above-mentioned samples 1 to 10 were brought into the preparation chamber, and were respectively set in position to the hook block 8*d* of the hoist 8. Then, after having closed the open-close door 4*b*, the preparation chamber 4*a* was evacuated once again by the vacuum pump P.

In the dipping chamber 2*a*, when the temperature of Dy exceeded 1400° C. as a result of heating, Dy ingots got melted. By controlling the heating means, an attempt was made to keep the temperature of the molten bath at 1440° C. Then, Ar gas was introduced through the gas introduction pipe 7*b* into the preparation chamber 4*a* until the pressure therein attained the same pressure as that in the dipping chamber 2*a*. Once the dipping chamber 2*a* and the preparation chamber 4*a* attained the same pressure, the gate valve 3 was opened. In this state, the motor 8*a* of the hoisting means was rotated in the normal direction of rotation to thereby lower the core member 1*a* through the hook block 8*d* from the preparation chamber 4*a* toward the dipping chamber 2*a*. The lowering speed at this time was set to 0.1 m/s. The core member was sequentially dipped into the molten bath of Dy and reached the dipping position. When the core member reached the dipping position, the motor 8*a* of the hoisting means was rotated in the opposite direction of rotation to thereby sequentially pull the core member 1*a* out of the molten bath. The pull-up speed at this time was set to 0.05 m/s.

Then, when the hook block 8*d* reached the mounting-dismounting position, the gate valve 3 was closed. In this state, Ar gas was introduced so that the pressure in the preparation chamber 4*a* was maintained at 100 kPa, and cooled for one minute. After cooling, Ar gas was further introduced into the preparation chamber 4*a* to bring it back to the atmospheric pressure. The open-close door 4*b* was opened to bring out the evaporating materials 1.

Figure 8:
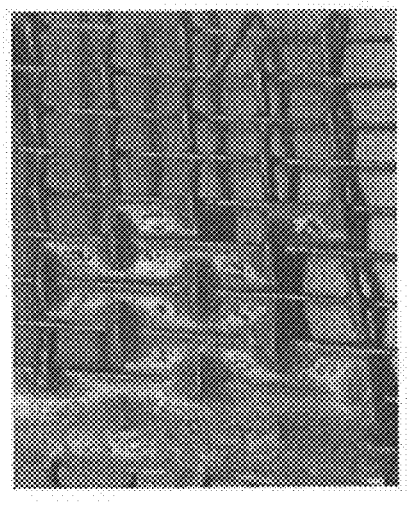
FIGS. 8(*a*) and 8(*b*) are photographs of external appearance of the evaporating material manufactured according to Example 1.
Figure 8:
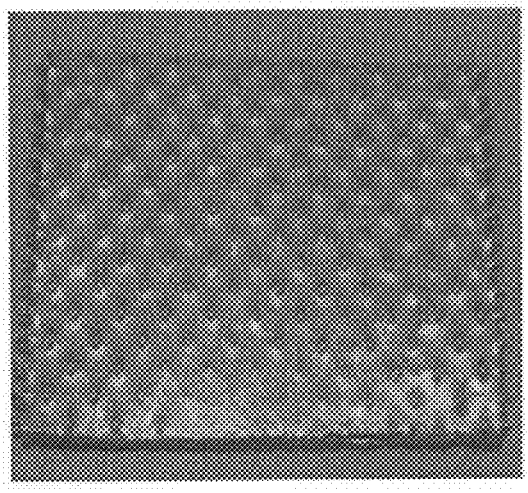

FIG. 7 is a table showing the volumetric ratio (regions free from adhesion of Dy) and the weight of Dy by varying, respectively, the material of the wire, as well as the diameter and meshes of the wire. FIG. 8 are photographs showing appearances of sample 2 (FIG. 8(*a*)), and sample 5 (FIG. 8(*b*)). According to them, samples 1 and 2 show that Dy failed to effectively adhere and, therefore, they were found unfit for forming into evaporating materials. On the other hand, in samples 3 and 9, Dy can be seen to have adhered to the core member 1*a* in such a manner that each of the meshes was filled over the entire region of the core member 1*a* and also that Dy got adhered to the entire region of the core member 1*a*. Especially, in samples 4 to 6, it can be seen that Dy got adhered in weight over 45 grams.

Example 2

In Example 2, by using the dipping apparatus M1 shown in FIG. 2 and by using sample 5 in Example 1 as the core member 1*a*, the evaporating materials 1 were manufactured under the same conditions as those in Example 1, except that the pull-up speed at the time of pulling up the core member 1*a* from the dipping position was varied.

FIG. 9 is a table showing the result of judging the availability as to whether the product obtained can be used as the evaporating material when the pull-up speed at the time of pulling up was varied at 0.005 to 1 m/sec. In FIG. 9, those that have been judged, in a visual inspection, to be unfit for mass production due to the occurrence of splashes on the external surfaces are marked with "x." According to this inspection, it has been confirmed that the evaporating materials 1 could be manufactured at good efficiency if the speed range falls within 0.01 to 0.5 m/sec.

Example 3

In Example 3, by using the dipping apparatus M2 as shown in FIG. 4, solidified bodies 10*b* have been manufactured on the surfaces of the core members 10*a*. As the core members 10*a* there were prepared, respectively, a Mo make of columnar shape (sample 1) worked into 200 mm in diameter×300 mm, and of a prismatic shape (sample 2) worked into 150 mm in square shape×300 mm. Regarding sample 1, as the core member 10*a*, there was prepared one made of C, Si, Mg, Nb, Ta, Ti, W, Mo, V or Cu. Further, as the rare-earth to get adhered, there was used Dy (composition ratio 99%). Processing treatments were carried out on samples 1 and 2 under the following same conditions.

First, ingots (100 g) of Dy were set in position into the crucible (300 mm in diameter×500 mm). After closing the gate valve 3 and isolating the dipping chamber 2*a*, the vacuum pump P was operated to thereby start evacuation and, at the same time, the heating means 6 was operated to start heating. Then, heating was performed while maintaining the dipping chamber 2*a* at 1 Pa. When the temperature of Dy reached 800° C., Ar was introduced into the dipping chamber 2*a* through the gas introduction pipe 7*a*.

On the other hand, the preparation chamber 4*a* was once reduced in pressure by the vacuum pump P down to 1 Pa in a state of closing the open-close door 4*b* and was left for 2 minutes to thereby degas the preparation chamber 4*a*. Thereafter, Ar was introduced until the preparation chamber 4*a* reached atmospheric pressure. Then, the open-close door 4*b* was opened to bring the above-mentioned samples 1 and 2 into the preparation chamber. The samples were respectively set to the clamp 82 of the hoist 80. Then, after having closed the open-close door 4*b*, the preparation chamber 4*a* was once again evacuated by the vacuum pump P.

In the dipping chamber 2*a*, when the temperature of Dy has reached 1407° C. as a result of heating, the ingots of Dy started to get melted. By controlling the heating means, the molten bath temperature was maintained at 1500° C. Then, Ar gas was introduced into the preparation chamber 4*a* through the gas introduction pipe 7*b* until the same pressure as that in the dipping chamber 2*a* was reached. When the dipping chamber 2*a* and the preparation chamber 4*a* attained the same pressure, the gate valve 3 was opened. In this state, the motor 8*a* of the hoisting means was rotated in the normal direction of rotation to lower the base member 10*a* through the clamp 82 from the preparation chamber 4*a* toward the dipping chamber 2*a*. The lowering speed at this time was set to 0.05 m/sec. In this manner, the base member 10*a* was sequentially dipped into the molten bath of Dy so as to reach the dipping position. Once the base member has reached the dipping position, it was held for 5 seconds and thereafter the motor 8*a* of the hoisting means was rotated in the opposite direction of rotation so as to pull out the base member 10*a* out of the molten bath through the clamp 82. The pull-up speed at this time was set to 0.02 m/sec.

Then, when the clamp 82 reached the mounting-dismounting position, the gate valve 3 was closed. In this state, Ar gas was introduced into the preparation chamber 4*a* so that the pressure therein can be maintained at 100 kPa and cooled the base member for 2 minutes. After cooling, Ar gas was further introduced into the preparation chamber 4*a* to bring the preparation chamber back to atmospheric pressure. The open-close door 4*b* was opened and brought out the base member.

FIG. 10 is a table showing the specific heat, specific weight, and thermal capacity per unit volume of each of the materials of the base member 10*a* of sample 1. According to this table, in the case of base member 10*a* made of Nb, Ta, Ti, W, Mo or V and sample 2, those portions, out of the base member 10*a*, which are dipped into the molten bath can be recognized to have formed a solidified body of Dy in a substantially uniform thickness. According to this result, it has been found that the material whose thermal capacity (specific heat×specific weight) per unit volume was 2 to 3 $MJ/km^3$ is suitable. On the other hand, in the case of base member made of C, Si or Mg, little or no Dy was found to have adhered. In addition, in the case of base member made of Cu, the molten bath of Dy was solidified. Further, when a pulling force was applied to the base member 10*a* with the solidified body having been fixed, the base member could be easily pulled out of the solidified body. The thickness of the solidified body was measured to be 2.0 mm. In addition, when this product was subjected to rolling work in a known method, it could be worked into 0.3 mm.

DESCRIPTION OF REFERENCE NUMERALS AND CHARACTERS

1, 10 evaporating material
1*a* core member
1*b* wire mesh (through hole)
10*a* base member
10*b* solidified body
W wire material
Dy (rare-earth metal)
M1, M2 dipping apparatus

What is claimed is:

1. A method of manufacturing an evaporating material comprising the steps of:

forming a solidified body of a rare-earth metal or of an alloy thereof by melting the rare-earth metal or the alloy thereof, by dipping a base member made of a fire-resistant metal into a molten bath of the rare-earth metal or of the alloy thereof in a state of maintaining the base member at a temperature below the melting temperature of the rare-earth metal or the alloy thereof, and thereafter by pulling up the base member to thereby form on a surface of the base member the solidified body;

detaching the solidified body off from the base member; and working the solidified body thus detached into a plate shape.

2. The method of manufacturing the evaporating material according to claim 1, wherein the base member is columnar shape or prismatic shape.

3. The method of manufacturing the evaporating material according to claim 1, further comprising increasing or decreasing the time of dipping the base member into the molten bath, thereby controlling a thickness of the solidified body.

4. The method of manufacturing the evaporating material according to claim 1, further comprising changing the temperature of the base member when dipping the base member into the molten bath, thereby controlling the thickness of the solidified body.

5. The method of manufacturing the evaporating material according to claim 1, wherein the rare-earth metal is a member selected from the group consisting of terbium, dysprosium, and holmium.

6. The method of manufacturing the evaporating material according to claim 1, wherein the fire-resistant metal is a member selected from the group consisting of niobium, molybdenum, tantalum, titanium, vanadium, and tungsten.

7. The method of manufacturing the evaporating material according to claim 1, wherein the working includes cutting, rolling, or pressing.

* * * * *